United States Patent [19]

Sigl et al.

[11] Patent Number: 5,030,375

[45] **Date of Patent: * Jul. 9, 1991**

[54] POWDER-COATED LAUNDRY DETERGENT SHEET

[75] Inventors: Wayne C. Sigl, Neenah; Frank C. Murray, Appleton, both of Wis.

[73] Assignee: Kimberly-Clark Corporation, Neenah, Wis.

[ * ] Notice: The portion of the term of this patent subsequent to Apr. 24, 2007 has been disclaimed.

[21] Appl. No.: 445,561

[22] Filed: Dec. 5, 1989

Related U.S. Application Data

[63] Continuation of Ser. No. 189,934, May 3, 1988, Pat. No. 4,919,835.

[51] Int. Cl.[5] ..... C11D 11/00; C11D 17/06; B05D 3/12

[52] U.S. Cl. ..... 252/91; 252/90; 252/174; 252/174.18; 252/174.19; 252/DIG. 11; 427/242

[58] Field of Search ..... 252/90, 91, 174, DIG. 11, 252/174.18, 174.19; 427/242

[56] References Cited

U.S. PATENT DOCUMENTS

| | | | |
|---|---|---|---|
| 4,511,495 | 4/1985 | Melville | 252/522 A |
| 4,652,390 | 3/1987 | Strampach et al. | 252/92 |
| 4,740,326 | 4/1988 | Hortel et al. | 252/90 |
| 4,793,941 | 12/1988 | Serbiak et al. | 252/91 |
| 4,814,099 | 3/1989 | Lloyd | 252/91 |
| 4,853,142 | 8/1989 | Win et al. | 252/90 |
| 4,865,755 | 9/1989 | Lloyd | 252/91 |
| 4,919,835 | 4/1990 | Sigl et al. | 252/91 |

*Primary Examiner*—Paul Lieberman
*Assistant Examiner*—A. Beadles-Hay
*Attorney, Agent, or Firm*—Gregory E. Croft

[57] ABSTRACT

A laundry detergent sheet is saturated with active detergent solids and thereafter coated with the balance of the detergent formulation in the form of a powder, thereby increasing the active detergent solids content of the sheet and at the same time improving the surface feel characteristics.

1 Claim, 1 Drawing Sheet

POWDER-COATED LAUNDRY DETERGENT SHEET

This is a continuation of application Ser. No. 189,934, filed on May 3, 1988, now U.S. Pat. No. 4,919,835.

BACKGROUND OF THE INVENTION

Laundry detergents are most commonly available in either liquid or powder form. In order to use such detergents, the user must measure out a certain quantity from a supply bottle or box and pour the measured amount into the clothes washer. In addition, if a fabric softener is desired, the fabric softener must be separately measured or at least separately deposited into the washer or dryer. Such multiple products, containers, and measuring can be messy and, at the very least an inconvenience, particularly for apartment dwellers who must carry all the necessary containers, etc., to the laundry area.

In this regard, the prior art discloses a variety of alternative cleaning products which are intended to provide improved convenience to the consumer. For example, U.S. Pat. No. 4,356,099 to Davies et al. discloses a laundry cleaning product comprising a plastic bag containing a liquid detergent. The bag has a weak seal which is opened by the mechanical action of the washing machine, thereby releasing the liquid detergent.

U.S. Pat. No. 4,188,304 to Clarke et al. discloses a similar detergent product comprising a plastic bag containing a particulate detergent. The bag contains a water-sensitive seal which discharges the contents of the bag when contacted with water.

U.S. Pat. No. 3,686,075 to Morton discloses a sheet substrate containing a fabric softener which is to be preferably used in the clothes dryer, but can also be added to a wash machine during its rinse cycle.

U.S. Pat. No. 4,170,565 to Flesher et al. discloses a laundry product comprising a detergent composition contained between two layers of a water-insoluble permeable substrate such as a polypropylene meltblown web. When contacted by water during the wash cycle, the detergent is dissolved and permeates through the substrate into the wash water. Most significantly, at column 1, lines 56–65, Flesher et al. apparently recognize the potential value of a single layer substrate for delivering laundry detergent, but concluded it is not feasible because of difficulty in loading the substrate with a sufficient amount of detergent and the sticky feel of any product that might be produced.

Therefore there is a need for a laundry cleaning product containing a sufficient premeasured amount of detergent which is convenient to use and economical to manufacture.

SUMMARY OF THE INVENTION

In attempting to incorporate a liquid detergent formulation into a nonwoven web substrate in an amount sufficient to wash a load of laundry, it has been discovered that the presence of certain detergent ingredients, namely the detergent enhancers, inhibit the incorporation of high levels of detergent solids with the meltblown web. For purposes herein, the "detergent enhancers" include water softening agents, anti-redeposition agents, and salts. For example, carboxymethyl cellulose, which is used as an anti-redeposition agent, causes the detergent composition to thicken, which makes homogeneous mixing more difficult. Also, sodium citrate and ethylenediaminetetraacetic acid (EDTA), which are used as water softening agents, cause phase separation of the liquid detergent and make uniform saturation of the meltblown web difficult. These disadvantages are overcome by separately adding the dry detergent formulation ingredients, including the detergent enhancers, to the surface of the sheet containing the liquid detergent formulation ingredients and adhering the dry ingredients to the sheet by taking advantage of any stickiness or tackiness which may be present due to the liquid ingredients. At the same time, the presence of the dry powder advantageously improves the feel of the sheet. As used herein, "powder" refers to dry granulated solids having an average particle size which is capable of passing through a twenty mesh screen and preferably is capable of passing through an eighty mesh screen.

Hence, in one aspect the invention resides in a method for making a cleaning product comprising a nonwoven web containing an amount of liquid detergent sufficient to wash a load of laundry, said method comprising separately incorporating into the web active detergent solids and detergent enhancers.

In another aspect, the invention resides in a cleaning product comprising a nonwoven web containing at least 1 gram of active detergent solids per gram of web and further comprising a powdered surface coating of at least one dry liquid detergent ingredient. The amount of active liquid detergent solids is preferably from about 2 to about 5 grams per gram of web and most preferably from about 3 to about 4 grams per gram. The amount of active detergent solids retained by the meltblown web has been measured to be as high as about 12 grams per gram and will depend upon the detergent formulation, the extent to which it is condensed, the basis weight and area of the web, and the pattern bonding area of the web. The capacity of the web to hold detergent will decrease as the pattern bonding area is increased. Hence it is necessary to strike a balance between detergent capacity and web integrity during use. Generally, the pattern bonding area can range from about 5 to about 40 percent of the total surface area of the web, with from about 10 to about 20 percent being preferred, and about 15 percent being most preferred.

In another aspect, the invention resides in a method for making the powder-coated cleaning product comprising: (a) saturating a nonwoven web with an aqueous solution comprising the active detergent solids of a liquid detergent formulation; (b) drying the saturated web to condense the solution to an active detergent solids content of at least 1 gram per gram of web; and (c) coating the surface of the dried web with powdered detergent formulation ingredients. The powdered ingredients can be added to the web before drying, after partial drying, or after complete drying of the web. Adhesion of the powder may be enhanced when applied to a moist web.

The nonwoven web can be any nonwoven web made from a thermoplastic polymer having a melting point greater than 110° C. Meltblown webs are preferred because of their ability to absorb and retain large amounts of liquid detergent. Polymers which melt at lower temperatures are more likely to melt if exposed to clothes dryer temperatures. A suitable polymer is polypropylene, which is the most commonly used polymer for making meltblown webs. However, polymers having melting points above 165° C. and preferably above 200° C. are preferred. Specific preferred polymers include poly(ethylene terephthalate), which melts at about 250° C., poly(butylene terephthalate), which melts at about 221° C., polycaprolactam (nylon 6), which melts at about 220° C., and polymethyl pentene, which melts at about 240° C.

The process for making meltblown webs is well known in the art and is used extensively for manufacturing a wide variety of commercial nonwoven products. Representative examples of the meltblowing process are disclosed in U.S. Pat. No. 3,978,185 to Buntin et al. dated Aug. 31, 1976 and U.S. Pat. No. 4,298,649 to Meitner dated Nov. 3, 1980. For purposes of meltblowing, it is preferred that the apparent viscosity of the polymer as it leaves the die tip be about 500 poise or less, most preferably from about 150 to about 300 poise. Higher apparent viscosities provide lower throughputs which are generally unsatisfactory for commercial production. Increased throughputs can be achieved by lowering the apparent viscosity, which can be lowered either by lowering the molecular weight of the polymer or by raising the temperature of the polymer. It will be appreciated, however, that other meltblowing process will produce webs suitable for purposes of this invention. The meltblown web can be combined or laminated to other supporting webs, such as spunbonded webs, in order to impart strength or other attributes to the product.

The basis weight for a single sheet of the untreated meltblown base webs of this invention can range from about 80 to about 300 grams per square meter. Preferably the basis weight will be from about 110 to about 250, and most preferably about 165 grams per square meter. Basis weights lower than the abovesaid range lack sufficient pore volume to hold the amount of liquid detergent necessary to wash a load of laundry at a reasonable sheet size. Basis weights greater than the abovesaid range are too difficult to convert. It is within the scope of this invention, however, to incorporate more than one ply into the product to increase the detergent load.

The size of the meltblown web can be from about 200 to about 2000 square centimeters, preferably from about 600 to about 1,000 square centimeters, and most preferably about 800 square centimeters. The minimum size of the web is limited by the amount of liquid detergent the web can absorb and hold. The maximum size is determined by consumer acceptance, convenience and packaging considerations. It is preferred that the meltblown web be pattern bonded to maintain integrity during use. Pattern bonding is commonly performed during manufacture of the meltblown web by hot embossing or ultrasonic bonding of the newly formed web. The product of this invention can be dispensed in sheet form or from perforated rolls. In addition, the single sheets can be perforated to be torn in half for half loads of laundry.

The liquid detergent formulations useful for making the products of this invention can be any liquid detergent formulation which is suitable for cleaning laundry. As is well known in the detergent arts, these formulations typically contain a large number of components such as surfactants, solubilizers, fragrances, brighteners, dyes, pH adjusters, anti-redeposition compounds, and water softening agents. For purposes of processing, it is preferable that the liquid ingredients portion of the detergent formulation contain at least 60 weight percent active detergent solids in order to minimize drying costs, although liquid detergents having at least 25 weight percent solids are suitable.

The detergent ingredients to be incorporated into the nonwoven web in liquid form and condensed primarily include the active detergent solids (surfactants) of the detergent formulation. These include nonionic surfactants, anionic surfactants, amphoteric surfactants, and cationic surfactants. Other ingredients can also be incorporated with the active detergent solids, including emulsifiers, pH control agents, dyes, foam control agents, brighteners, enzymes, and fragrances.

The dry powdered detergent ingredients to be added to the surface of the web primarily include the detergent enhancers which are responsible for phase separation tendencies of the liquid detergent formulation. As previously mentioned, the detergent enhancers include the water softening agents, anti-redeposition agents, and salts such as sodium citrate, EDTA salts, sodium carbonate, sodium silicate, phosphates, aluminosilicates, nitrilotriacetic acid salts, sodium borate, carboxymethyl cellulose, poly(vinyl alcohol), poly(vinyl acetate), and polyvinylpyrrolidone. Other powdered ingredients can also be added with the surface coating, including pH control agents, enzymes, brighteners, and fragrances.

The amount of the dry powdered detergent ingredients added to coat the surface of the web can be from about 0.01 to about 0.7 grams per gram of saturated web. The amount will vary depending upon the detergent formulation and the particular ingredients added in dry form.

It is preferred that the meltblown web also contain a fabric softener which softens the laundry during the drying cycle. Webs impregnated with such softening agents are well known in the art and are well known commercial products. Suitable fabric softening agents include those described in U.S. Pat. No. 3,686,025 to Morton, dated Aug. 22, 1972.

DETAILED DESCRIPTION OF THE DRAWING

Figure 1:
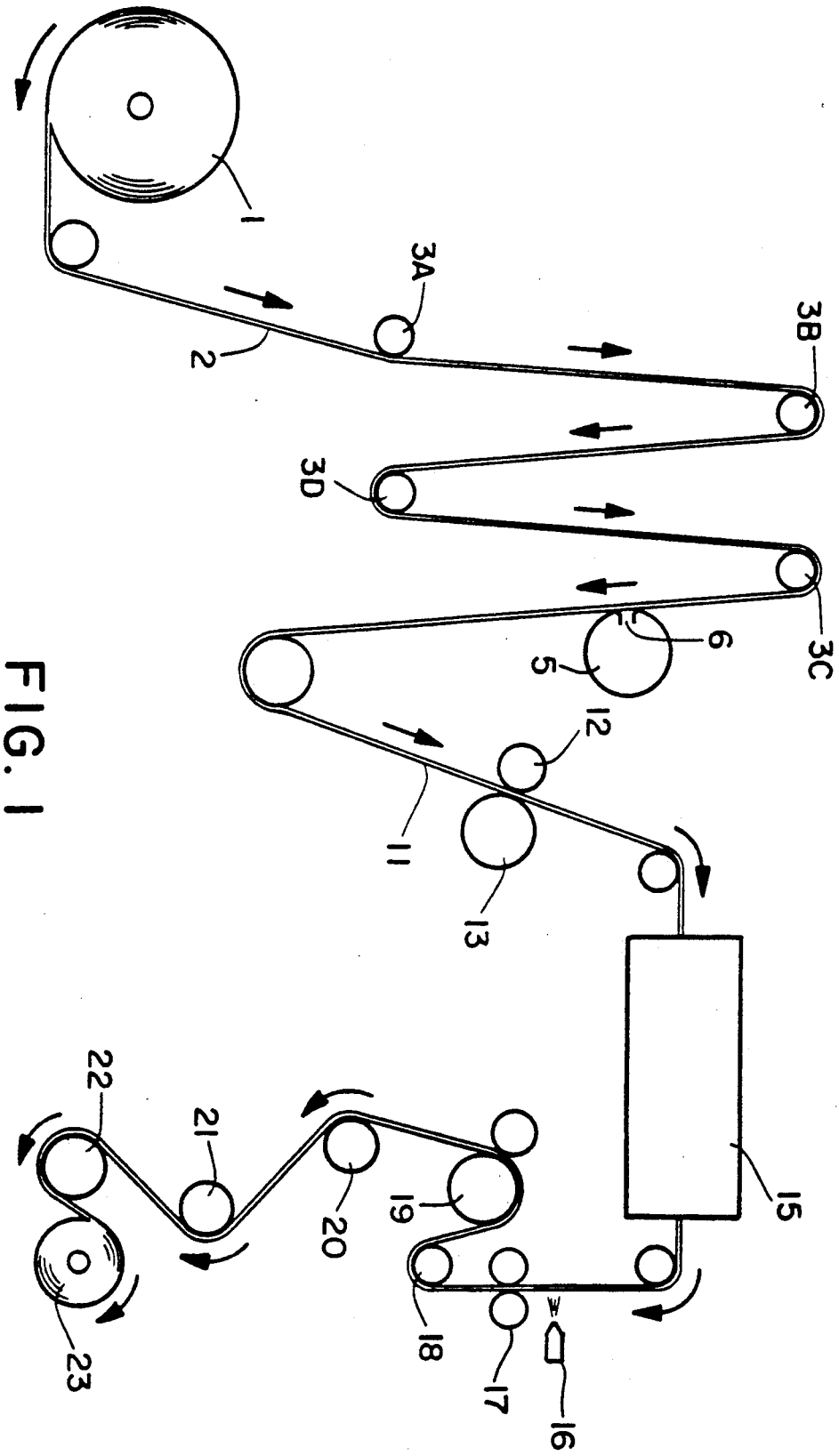
FIG. 1 is a schematic view of a process for making the product of this invention.

Directing attention to FIG. 1, shown is a supply roll 1 of the meltblown web material to be saturated with liquid detergent ingredients. Preferably the web has been thermally pattern-bonded to provide sufficient integrity to withstand a wash and dry cycle without disintegrating. The web 2 is passed through a series of tension control rolls 3A, 3B, 3C, and 3D and passed over a slotted bar applicator 5 which is filled with an aqueous solution containing active detergent solids and, if desired, other compatible detergent formulation ingredients. The solution is deposited onto the web through slot 6 to saturate the web with solution. The rate at which the solution is applied will depend upon the line speed, the detergent composition, the absorbency of the web, etc. Other means for incorporating the solution into the web are also suitable, however. The solution can be applied to either or both sides of the web.

After leaving the slotted bar applicator, the saturated web 11 passes through a controlled nip between nip rolls 12 and 13 which serves to enhance the even distribution of the solution throughout the web.

The saturated web then passes through a dryer 15, preferably an air flotation dryer, which preferably removes substantially all (up to about 95 percent) of the available moisture, which includes alcohol and water. More typically the moisture removal will be on the order of about 80 percent. The product leaving the dryer contains concentrated liquid detergent having a gel-like consistency, yet the web has an acceptable feel. Nevertheless, there is sufficient tackiness to cause the subsequently-applied powdered ingredients to adhere under pressure.

After the web is dried, the powdered, dry detergent formulation ingredients are applied to the web in any suitable manner. As shown, the powdered ingredients can be sprayed onto the surface of the web using a powder spray device 16. Other means for applying the powder can also be used, such as vibrating tray units, brush applicators, etc. The powder can be applied to one or both sides of the web. Thereafter, the powder-coated web is calendered to press the powder into the web and increase the degree of adhesion of the powder to the web.

After the addition of the powdered ingredients, the dried powder-coated web passes around a tension control roll 18, a pull roll 19, a slitter roll 20, a Mount Hope roll 21, and a rewind drive roll 22. The powder-coated web is thereby wound onto the rewind roll 23 for subsequent converting and packaging operations. Because of the presence of the powder on the surface of the web, the web has less tendency to "block" when wound into a roll.

It will be appreciated that the foregoing description, given for purposes of illustration, is not to be construed as limiting the scope of this invention.

We claim:

1. A method for making a laundry cleaning product comprising separately coating a nonwoven web with a dry detergent enhancer selected from the group consisting of sodium citrate, salts of ethylenediaminetetraacetic acid, and carboxymethyl cellulose and active detergent solids selected from the group consisting of anionic, nonionic, cationic, and amphoteric surfactants.

* * * * *